US005125070A

United States Patent [19]

Chung-Tai

[11] Patent Number: 5,125,070

[45] Date of Patent: Jun. 23, 1992

[54] PTC HEATER ASSEMBLY WITH SECURELY POSITIONED PTC RESESTORS

[76] Inventor: Chang Chung-Tai, No. 10, Lane 154, Chung Hwa Rd., Yung Kang Hsiung, Tainan, Taiwan

[21] Appl. No.: 653,534

[22] Filed: Feb. 11, 1991

Related U.S. Application Data

[63] Continuation-in-part of Ser. No. 378,949, Jul. 11, 1989, Pat. No. 5,028,763.

[51] Int. Cl.[5] ..... H05B 1/02; H05B 3/06; F24H 3/04; F24H 1/10

[52] U.S. Cl. ..... 392/485; 219/505; 219/540; 219/541; 338/22 R; 392/365; 392/502

[58] Field of Search ..... 219/504, 505, 541, 540, 219/530; 338/22 R; 392/379, 385, 365, 360, 502, 488, 491

[56] References Cited

U.S. PATENT DOCUMENTS 4,667,644 5/1987 Hori et al. ..... 219/541 X
4,703,153 10/1987 Pelonis ..... 392/368

FOREIGN PATENT DOCUMENTS 1190579 7/1985 Canada ..... 392/365
52755 4/1977 Japan ..... 392/385
139140 10/1979 Japan ..... 219/505

*Primary Examiner*—Anthony Bartis
*Attorney, Agent, or Firm*—Varndell Legal Group

[57] ABSTRACT

A PTC heater for securely positioning resistors is disclosed. The PTC heater has two insulating plates having a plurality of square or rectangular through holes, a conductive position plate having a plurality of square or rectangular through holes facing toward those in the insulating plates and a resistor cavity defined by four angular-shaped fixing chips fixed on each of the four inside faces for positioning a PTC resistor therein, and a conductive elastic plate having a plurality of square or rectangular through holes facing toward those in the insulating plates. The elastic plate has an elastic projection on each of the four inside faces of a through hole for pressing a lateral surface of a PTC resistor positioned in a through hole of the position plate after the elastic plate and the position plate have been sandwiched between the two insulating plates.

7 Claims, 7 Drawing Sheets

PTC HEATER ASSEMBLY WITH SECURELY POSITIONED PTC RESESTORS

CROSS-REFERENCE TO RELATED APPLICATION

The present invention is a continuation-in-part of U.S. Ser. No. 07/378,949, filed on Jul. 11, 1989, now U.S. Pat. No. 5,028,763.

U.S. Ser. No. 07/378,949, entitled "High Heat Dissipation PTC Heater Structure, now U.S. Pat. No. 5,028,763 is considered to be improved to position more securely PTC resistors held between two frames. The present invention has been devised to supply a kind of PTC heater, wherein PTC resistors are possible to be quickly positioned in through holes in an electrically conductive position plate and elastically pressed by an electrically conductive elastic plate and both those plates re firmly sandwiched between two insulating plates such that the PTC resistors can be more securely kept between the position plate and the elastic plate without any possibility to move in their position and can be electrically powered without fail.

SUMMARY OF THE INVENTION

The invention has been devised to supply a kind of PTC heater which has a simple structure for easy, accurate assembling and of tight contact between PTC resistors and the frames.

The PTC heater in the present invention comprises two insulating plates, a conductive position plate, a conductive elastic plate and PTC resistors as the main components.

The two insulating plates have a plurality of square or rectangular through holes for the heat produced by the PTC resistors mounted in the through holes in the position plate to disperse out, and are assembled with the position plate and the elastic plate sandwiching firmly the position plate and the elastic plate between them.

The conductive position plate also has a plurality of square or recutangular through holes positioned to face correspondingly toward the through holes in the two insulating plates and each hole has a resistor cavity defined by four angular shaped clips fixed on the four inside faces for positioning a PTC resistor therein.

The conductive elastic plate also has a plurality of square or rectangular through holes positioned to face correspondingly toward the through holes in the two insulating plates and each hole has four elastic projections on its four inside faces near a PTC resistor to press elastically a lateral surface of the PTC resistor positioned in the resistor cavity in each through hole of the position plate after the elastic plate and the position plate have been assembled between the two insulating plates. Thus, all the PTC resistors can be mounted in the through holes in the position plate securely and elastically maintain in their position by the elastic plate without any possibility of moving or tilting to any side in the through holes of the position plate.

DETAILED DESCRIPTION OF THE INVENTION

Figure 1:
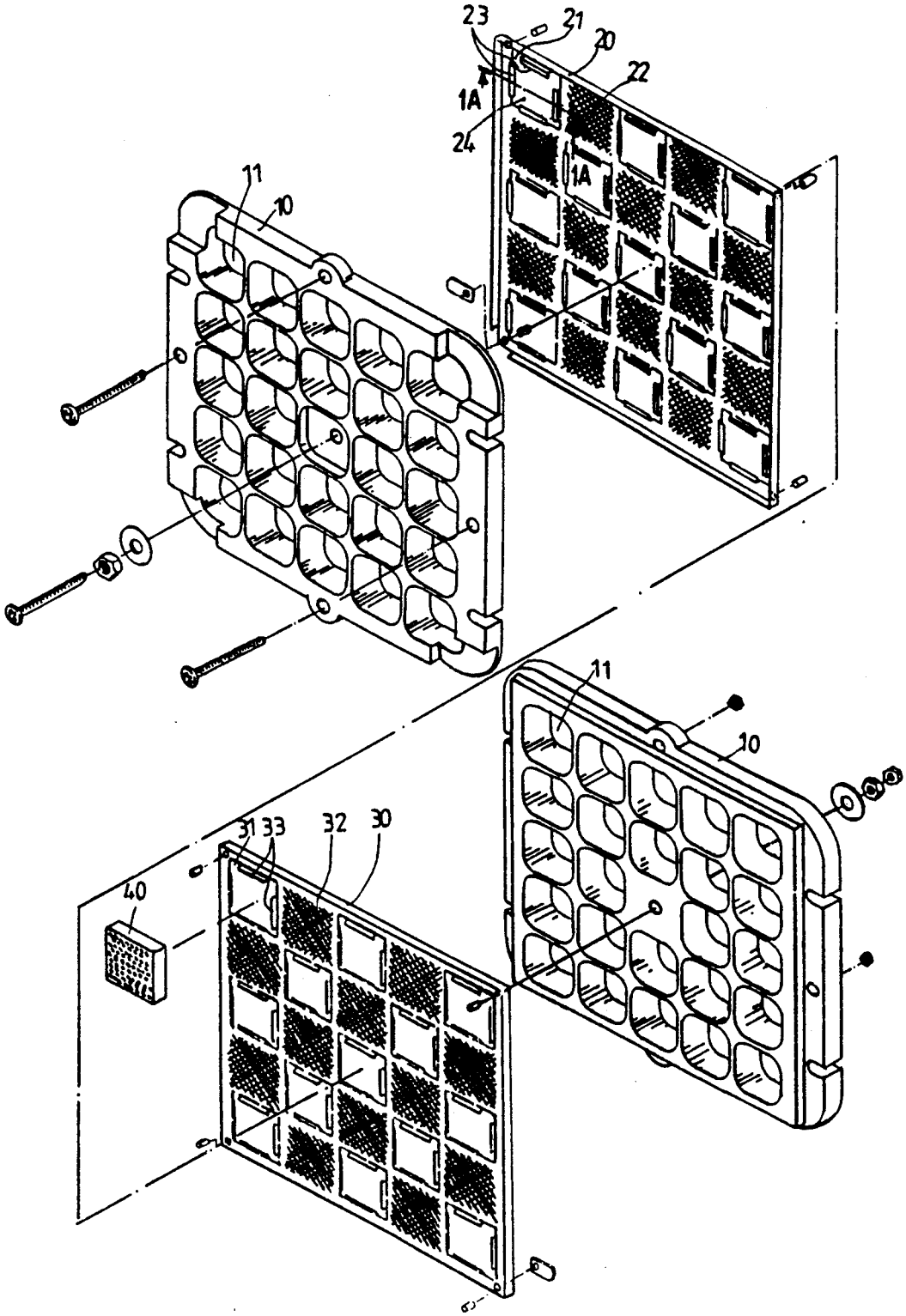
FIG. 1 is an exploded perspective view of the first embodiment of the PTC heater in the present invention.
Figure 1A:
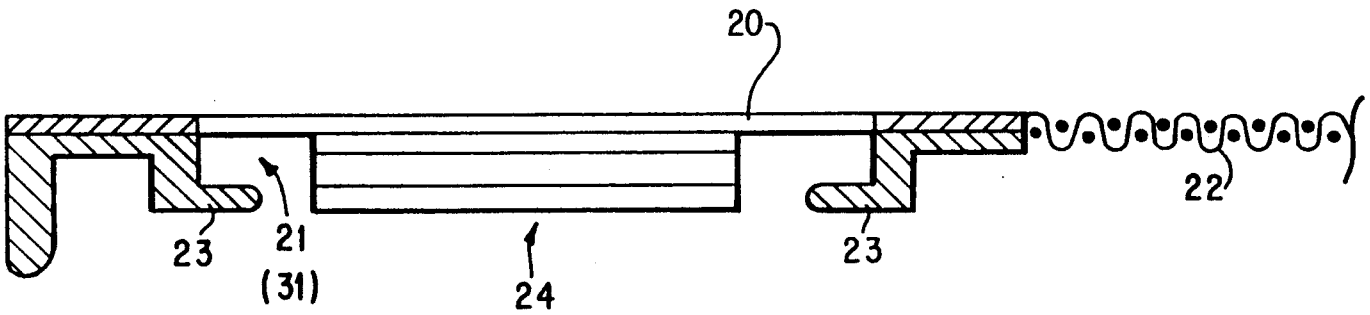
FIG. 1A is a cross-sectional view of the position plate of the present invention taken along line 1A—1A of FIG. 1.
Figure 2:
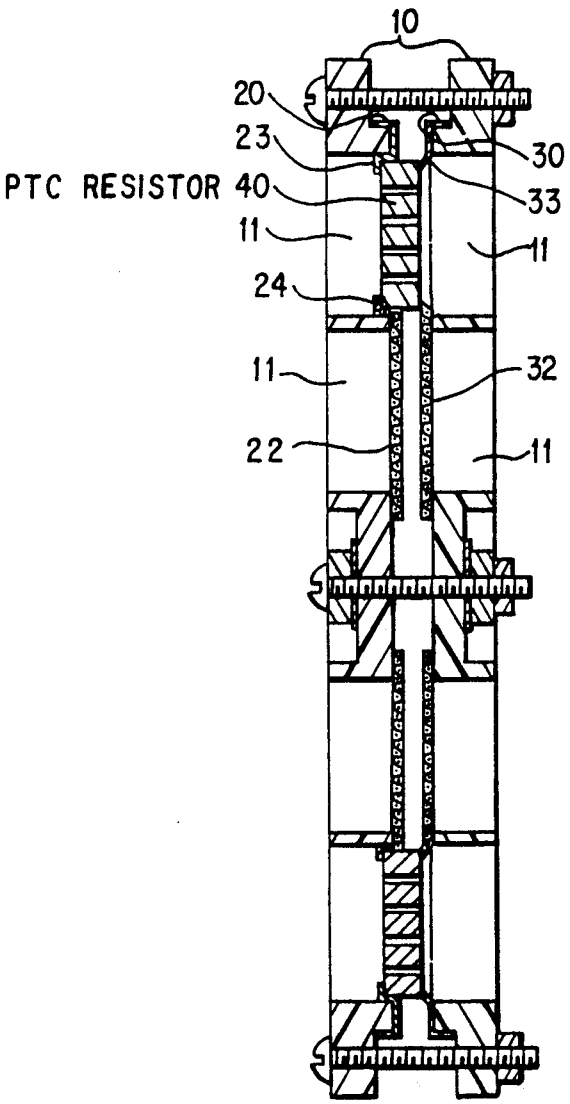
FIG. 2 is a side cross-sectional view of the first embodiment of the PTC heater in the present invention.
Figure 4:
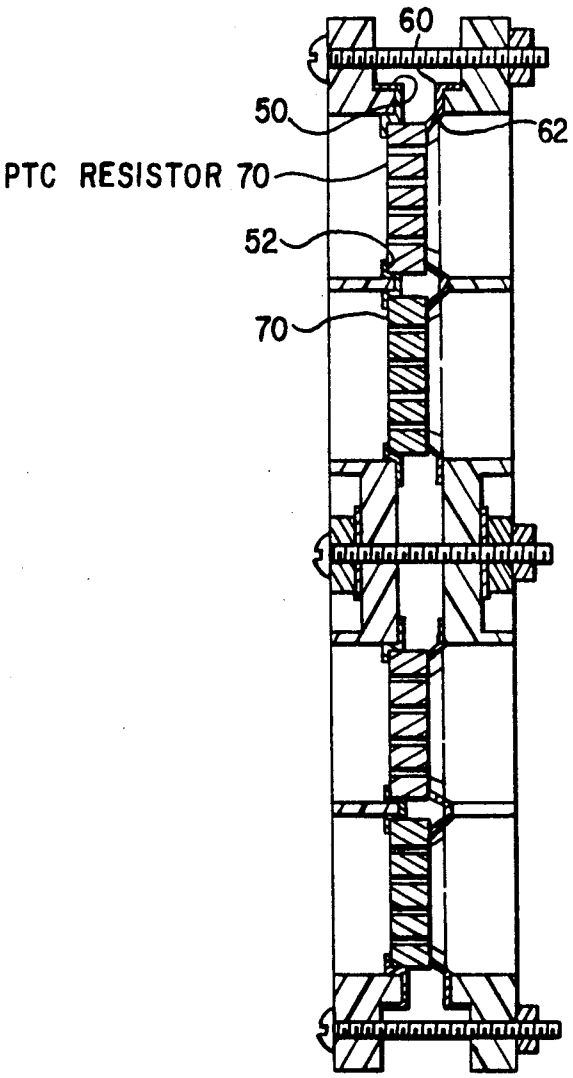
FIG. 4 is a side cross-sectional view of the second embodiment of the PTC heater in the present invention.

The PTC (positive temperature coefficient) heater in the present invention, as shown in FIGS. 1, 2, comprises two insulating plates 10, an electrically conductive position plate 20, an electrically conductive elastic plate 30 and a plurality of PTC resistors 40 as the main components.

The two insulating plates 10 preferably square or rectangular have a plurality of square or rectangular through holes 11 and each insulating plate can be separately combined with the conducting position plate 20 and the elastic plate 30 with rivets. Then the two insulating plates and the position plate 20 and the elastic plate 30 are assembled firmly together with bolts and nuts, and the insulating plates 10 sandwich the position plate 20 and the elastic plate 30 between them.

The position plate 20 and the elastic plate 30 have a plurality of square or rectangular holes 21, 31 for positioning PTC resistors 40 therein and a plurality of netted areas 22, 32 between each two through holes 21, 31 vertically and horizontally. The two insulating plates 10 are positioned at the outside of the position plate 20 and the elastic plate 30, having their through holes 11 facing correspondingly toward the through holes 21, 31 and the netted areas 22, 32 of the position plate 20 and the elastic plate 30. Through holes 11 enable the heat produced by the PTC resistors to disperse out.

Each through hole 21 is provided with an angle-shaped fixing clip 23 in each of its four inside faces and the four fixing clips define a cavity 24 for a PTC resistor to be positioned therein.

Each through hole 31 in the elastic plate 30 is provided with an elastic projection 33 on each of the four inside faces closest to the PTC resistor positioned in through holes 21 in the position plate so as to press elastically a lateral surface of the PTC resistor to secure it firmly without any possibility of moving or tilting of the resistor in the through hole 21 in the position plate 20.

Before the two insulating plates 10, the position plate 20 and the elastic plate 30 are all assembled together, each PTC resistor is placed in each fixing cavity 24 in each through hole 21 in the position plate 20. Then, two poles of electricity are separately connected with the position plate 20 and the elastic plate 30, and then this PTC heater is ready for use, applied to a blower, etc. The elastic projections 33 in the elastic plate 30 can elastically press a lateral surface of each PTC resistor 40 such that the electrical connection between the PTC resistors and the position plate 20 and the elastic plate 30 is very good after being assembled together. The PTC resistors are firmly and securely positioned in the cavities 24 of the position plate 20 and pressed by the projections 33. Whether the heater is vertically or horizontally moved or given a shock, they might not move or tilt in the cavities 24.

Figure 3:
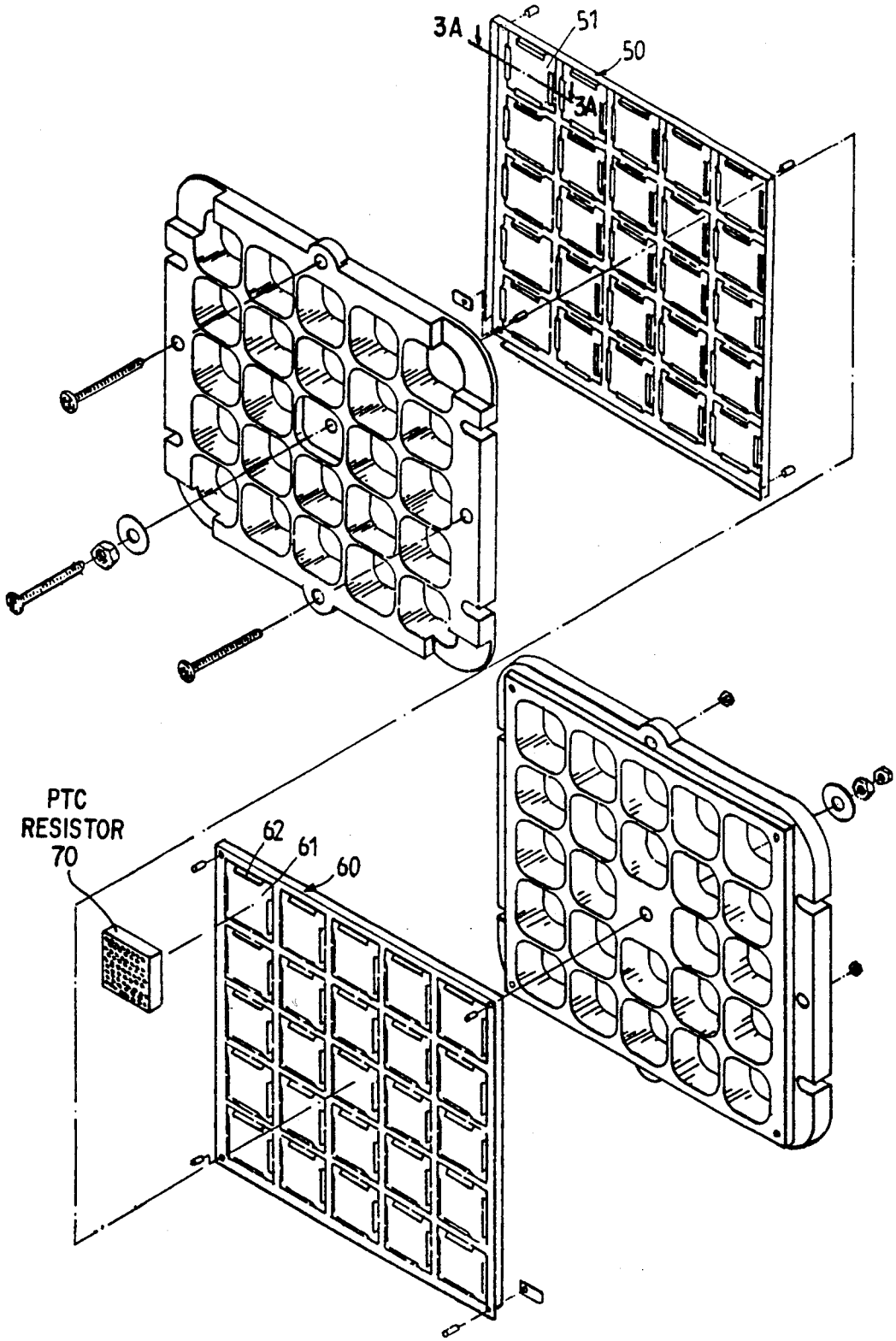
FIG. 3 is an exploded perspective view of the second embodiment of the PTC heater in the present invention.
Figure 3A:
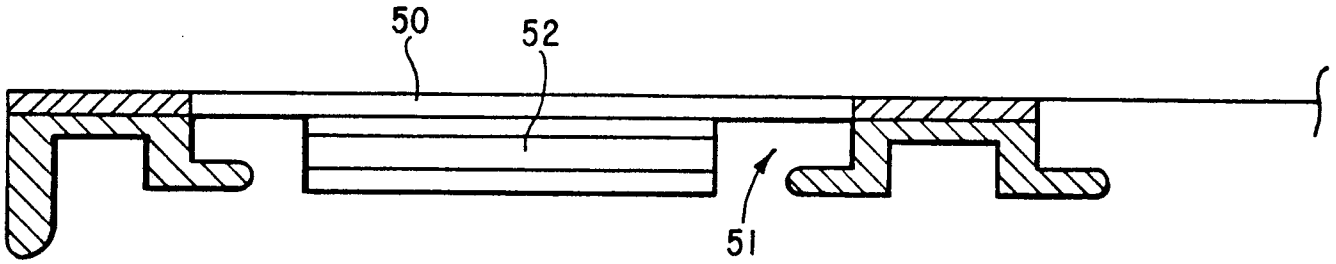
FIG. 3A is a cross-sectional view of the position plate of the present invention taken along line 3A—3A of FIG. 3 or a cross-sectional view of the position plate of the present invention taken along line 3A—3A of FIG. 5.

Next, the second embodiment of the PTC heater in the present invention, as shown in FIG. 3, 4, comprises the same two insulating plates 10 as in the first embodiment, a conductive position plate 50 and an elastic plate 60 similarly having through areas 51, 61 for positioning PTC resistors 52 but no netted holes. Each through hole 51 has a resistor cavity 52 defined by four angular-shaped fixing clips as in the first embodiment, and each through hole 61 has four elastic projections as in the first embodiment, and thus a PTC resistor 70 can be positioned in each cavity 52 and held securely by the elastic projections. This second embodiment is suitable for a large power but a small or medium dimensions.

As can be understood, these two embodiments of PTC heaters have a simple structure for assembling and an excellent conductivity among the PTC resistors, the position plate and the elastic plates.

Figure 5:
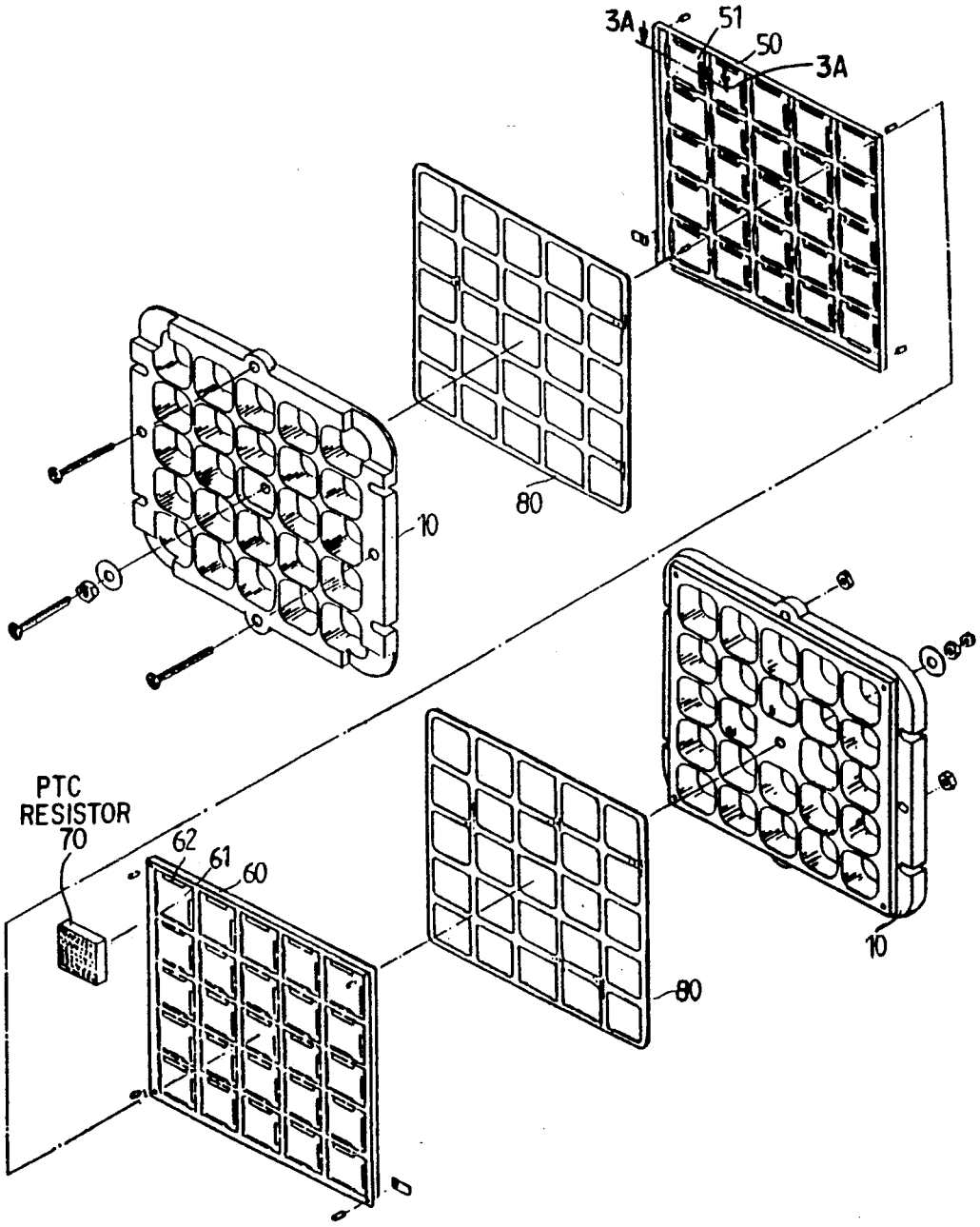
FIG. 5 is an exploded perspective view of the second embodiment of the PTC heater added with two supplementary plates in the present invention.
Figure 6:
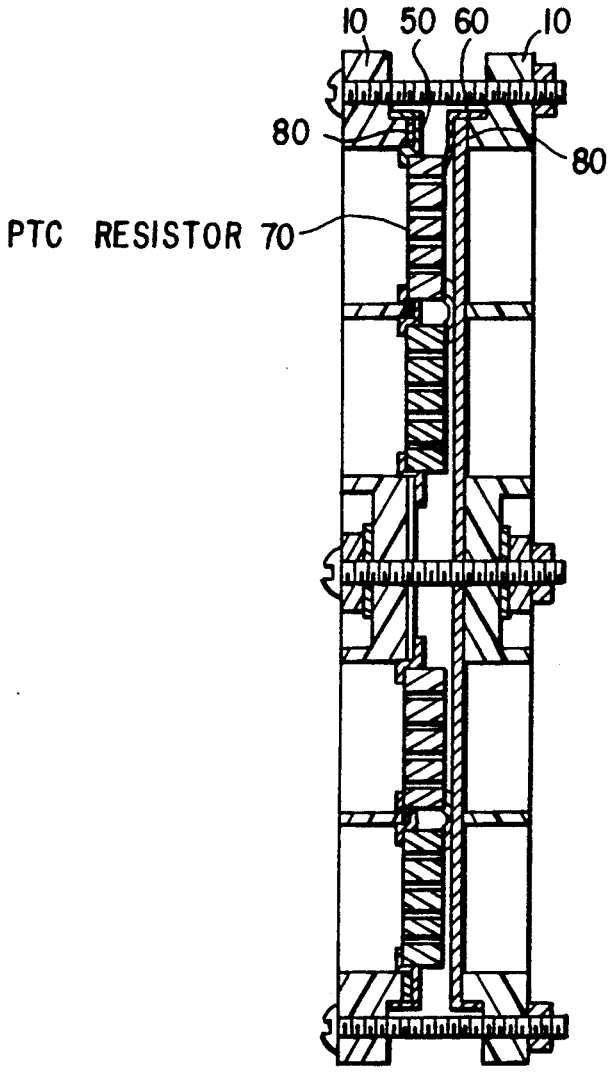
FIG. 6 is a side cross-sectional view of the second embodiment of the PTC heater added with two supplementary plates in the present invention.

Should the insulating plates 10 have insufficient strength to endure heat, a supplementary plate 80 having the same shape as the insulating plate 10 as shown in FIG. 5, 6 can be between the position plate 50 and one of the insulating plates 10 and between the elastic plate and the other insulating plate 10 to share the heat and the pressure the insulating plates receive.

What is claimed is:

1. A PTC heater comprising;

an electrically conductive position plate having a first side and a second side, and a plurality of through holes for positioning PTC resistors, each of said through holes having four angular-shaped clips on four inside faces defining a resistor cavity for a PTC resistor to be positioned in;

an electrically conductive elastic plate having a plurality of through holes positioned to face toward the through holes in the position plate, each of said through holes having an elastic projection on each of its four inside faces to elastically press a lateral surface of a PTC resistor;

means for securing the electrically conductive position plate to a first side of the electrically conductive elastic plate;

two insulating plates having a plurality of through holes positioned to face correspondingly toward the through holes in the position plates and the elastic plate;

means for securing to the second side of the elastic plate an insulating plate;

means for securing to a side of the position plate, not in contact with the elastic plate, a second insulating plate to firmly sandwich the position plate and the elastic plate between the insulating plates; and a plurality of PTC resistors, each mounted in the through holes of the position plate and held securely by the elastic projections in the through holes in the elastic plate, so as to generate heat when powered through the position plate and the elastic plate.

2. The PTC heater as claimed in claim 1, wherein a supplementary plate is provided between one of the two insulating plates and the position plate and between the other insulating plate and the elastic plate to share the heat and the pressure the insulating plates receive.

3. The PTC heater of claim 1, wherein said through holes have a rectangular shape.

4. The PTC heater as claimed in claim 3, wherein a supplementary plate is provided between one of the two insulating plates and the position plate and between the other insulating plate and the elastic plate to share the heat and the pressure the insulating plates receive.

5. The PTC heater of claim 1, wherein said resistors are in electrical contact with the position plate and the elastic plate.

6. The PTC heater of claim 1, wherein said through holes have a square shape.

7. The PTC heater as claimed in claim 6, wherein a supplementary plate is provided between one of the two insulating plates and the position plate and between the other insulating plate and the elastic plate to share the heat and the pressure the insulating plates receive.

* * * * *